United States Patent [19]

Mickelson

[11] Patent Number: 4,559,965

[45] Date of Patent: Dec. 24, 1985

[54] MULTIPLE COMPENSATING UNLOADING VALVE CIRCUIT

[75] Inventor: Roger D. Mickelson, West Burlington, Iowa

[73] Assignee: J. I. Case Company, Racine, Wis.

[21] Appl. No.: 569,416

[22] Filed: Jan. 9, 1984

[51] Int. Cl.[4] ..... F15B 13/09

[52] U.S. Cl. ..... 137/115; 91/28

[58] Field of Search ..... 137/117, 115; 60/428, 60/430; 91/28

[56] References Cited

U.S. PATENT DOCUMENTS

| | | | |
|---|---|---|---|
| 2,924,940 | 2/1960 | Covert et al. | 60/430 |
| 3,033,277 | 5/1962 | Cowles et al. | 137/117 |
| 3,467,126 | 9/1969 | Ballard et al. | 137/115 |
| 3,587,237 | 6/1971 | Pierrat | 60/430 |
| 4,184,331 | 1/1980 | Bentley | 60/430 X |

*Primary Examiner*—Martin P. Schwadron
*Assistant Examiner*—Stephen M. Hepperle
*Attorney, Agent, or Firm*—Cullen, Sloman, Cantor Grauer, Scott & Rutherford

[57] ABSTRACT

A multiple compensating unloading valve circuit including multiple fixed displacement pumps and corresponding compensator unloading valves which are phased so that one pump supplies the fluid demand for the circuit until the demand exceeds that pump's capacity and then another pump adds to the flow to supplier larger flow demands. Thus, a primary pump delivers its output to satisfy low flow requirements while a secondary pump's output is vented to a reservoir. When the primary pump cannot supply the demand, the secondary pump automatically adds to the flow to satisfy larger demands. The compensator unloading valves are closed center and are operated in response to a differential pressure which is created between the primary pump's outlet pressure and the load pressure. The primary pump unloading valve has a differential pressure setting which is greater than the differential pressure setting for the secondary pump unloading valve. This permits phasing of the unloading valves so that the primary pump supplies all of the fluid demand until the demand exceeds that pump's capacity.

1 Claim, 1 Drawing Figure

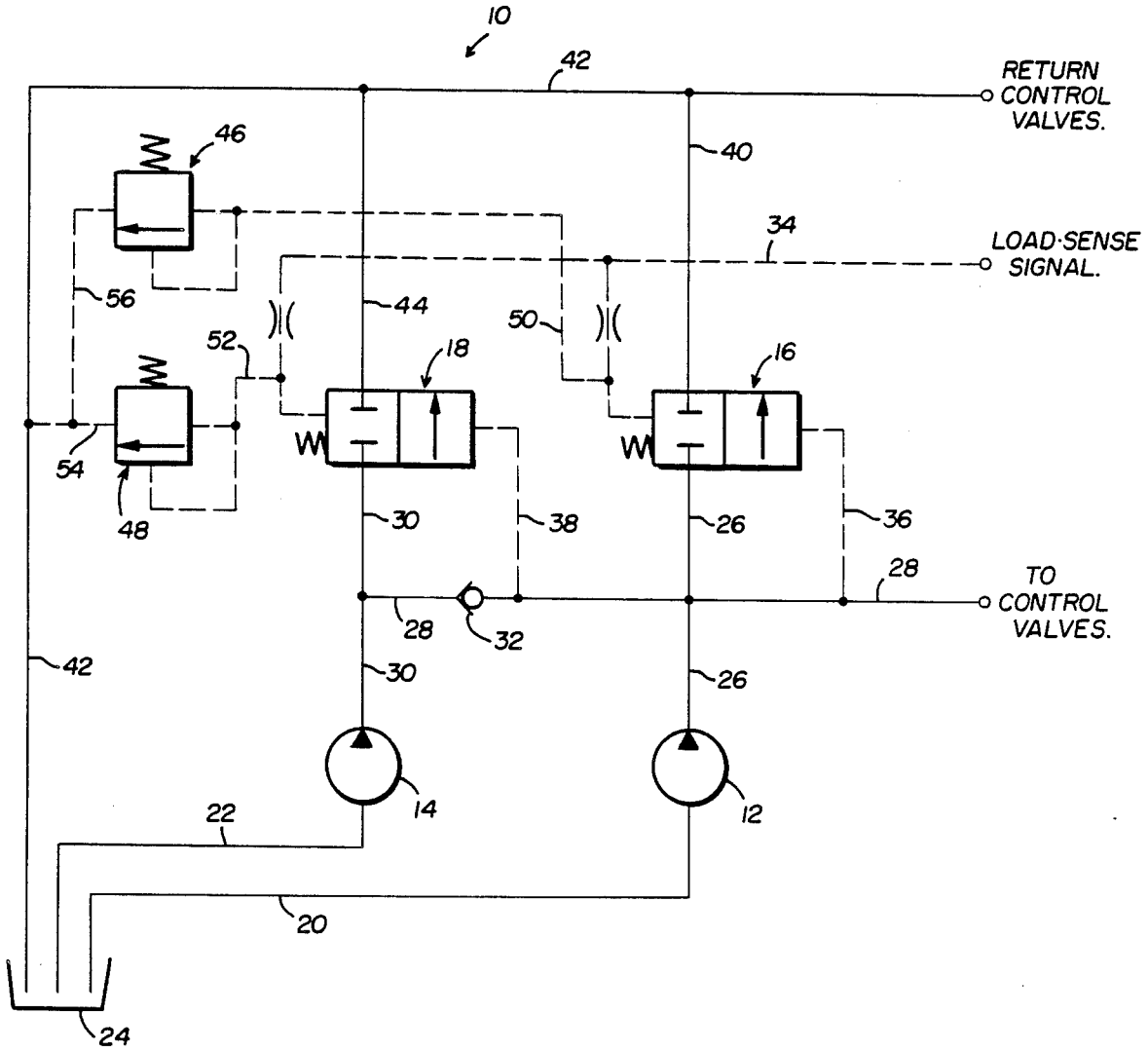
10
42
RETURN CONTROL VALVES.
46
40
34
LOAD-SENSE SIGNAL.
56
44
50
52
18
16
54
48
30
38
26
36
28
TO CONTROL VALVES.
28
32
42
30
26
14
12
22
20
24

MULTIPLE COMPENSATING UNLOADING VALVE CIRCUIT

BACKGROUND OF THE INVENTION

The present invention relates to a hydraulic circuit including multiple fixed displacement pumps and corresponding compensator unloading valves which are phased so that one pump supplies the fluid demand of the circuit until the demand exceeds that pump's capacity and then another pump adds flow to supply larger fluid demands.

It is common in earth-working equipment, such as backhoes, front-end loaders and the like, to have a bucket or shovel mounted on a tractor to be raised and lowered, tilted, or otherwise moved into the correct attitude by an appropriate mechanism for the work being performed at the moment. Such adjustments of the bucket or shovel are commonly made by hydraulic cylinders supplied with fluid pressure from a suitable pump.

A common mode of operation in earth-working is to move a bucket or shovel into a pile of material. The hydraulic systems for such earth-working applications require a high volume of fluid at low pressure to rapidly move the cylinder piston rods and, therefore, the bucket or shovel to the work. Then, low fluid volume under high pressure must be available to provide the necessary tilting of the bucket or shovel to break a portion of the material loose from the work pile or lift the material in the bucket or shovel.

One of the prior art approaches has been to provide two fixed displacement pumps to supply the required fluid under pressure for the hydraulic circuit. This allows for high flow at low pressure and low flow at high pressure for rapidly moving the bucket to the work and then working the bucket against a load without requiring increased power from the engine. While the use of multiple fixed displacement pumps permits a more energy efficient system, there has been a need for an improved multiple pump hydraulic circuit which is more fuel efficient and generates less heat. Thus, the present invention provides a more energy and cost efficient system than known circuits utilizing multiple fixed displacement pumps.

SUMMARY OF THE INVENTION

In accordance with the present invention, a hydraulic circuit is disclosed including multiple fixed displacement pumps and corresponding compensator unloading valves which are phased so that one pump supplies the fluid demand for the circuit until the demand exceeds that pump's capacity and then another pump adds to the flow to supply larger flow demands.

The disclosed hydraulic circuit includes two fixed displacement pumps with both pumps being connected to one or more conventional control valves which supply fluid to hydraulic cylinders for operating earth-working buckets, shovels, or the like. Each of the pumps is connected to a corresponding closed center compensator unloading valve with the unloading valves being phased so that one pump supplies all of the fluid demand until the demand exceeds that pump's capacity. Thus, a primary pump delivers its output to satisfy low flow requirements while a secondary pump's output is vented to a reservoir. When the primary pump cannot supply the demand, the secondary pump automatically adds to the flow to satisfy larger demands.

The closed center compensator unloading valves are operated in response to a differential pressure which is created between the pump outlet pressure and the load pressure. A load line is connected to one end of each of the unloading valves for sensing the load pressure downstream of the control valves. Each unloading valve is spring biased and the pressure signal from the load adds to the spring bias of the unloading valve. The other end of each unloading valve is connected to the supply line for the control valves for sensing the outlet pressure of the primary pump. The spring bias for the primary pump unloading valve has a pressure equivalent which is greater than the spring bias pressure equivalent of the secondary pump unloading valve. This permits phasing of the unloading valves so that the primary pump supplies all of the fluid demand until the demand exceeds that pump's capacity.

The primary pump unloading valve may be set at a differential pressure of, for example, 200 psi, which means that when the differential pressure between the pump outlet pressure and load pressure signal equals or exceeds 200 psi then the flow is limited to that setting. If the differential pressure for the primary pump unloading valve is set at 200 psi, then the differential pressure setting for the secondary pump unloading valve would be lower at, for example, 150 psi. With these settings, the primary pump would satisfy all of the fluid demand at lower flow requirements while the secondary pump would vent all of its flow to the reservoir at an energy savings. When the primary pump can no longer supply the demand, the differential pressure reduces which permits the secondary pump to start adding to the flow.

Further, the unloading valves include relief control which allows the venting of the flow from one or both pumps back to the reservoir when a preset high pressure is reached. This eliminates the need for a relief control in the control valve and thereby provides a cost advantage.

Other advantages and meritorious features of the multiple compensating unloading valve circuit of the present invention will be more fully understood from the following description of the invention, the appended claims, and the drawing, a brief description of which follows.

BRIEF DESCRIPTION OF DRAWING

The single FIGURE drawing is an illustration of the multiple compensating unloading valve circuit of the present invention.

DETAILED DESCRIPTION OF THE INVENTION

A preferred embodiment of the multiple compensating unloading valve circuit is illustrated in the single FIGURE drawing.

The hydraulic circuit 10 includes two fixed displacement pumps 12 and 14 which are connected to corresponding closed center compensator unloading valves 16 and 18 with the unloading valves being phased so that the primary pump 12 supplies all of the fluid demand until the demand exceeds that pump's capacity. Pumps 12 and 14 are connected by conduits 20 and 22 to a reservoir 24 for receiving hydraulic fluid. The discharge conduit 26 from primary pump 12 is connected to supply line 28 and to compensator unloading spool valve 16. Supply line 28 is, in turn, connected to one or more conventional closed center, load-sensing control valves (not shown) which supply fluid to hydraulic cylinders as is conventional for operating earth-working buckets, shovels, or the like. The discharge conduit 30 from secondary pump 14 is also connected to supply line 28 and to compensator unloading spool valve 18. A check valve 32 is connected in line 28 between pumps 12 and 14 to prevent backflow from primary pump 12 to compensator unloading valve 18.

The closed center compensator unloading valves 16 and 18 are phased so that primary pump 12 supplies all of the fluid demand for circuit 10 until the flow demand exceeds that pump's capacity. The spool unloading valves are operated in response to a differential pressure which is created between the primary pump outlet pressure in line 28 and the load-sensing pressure sent by the control valves (not shown). A load-sense line 34 is connected to one end of each of the unloading valves 16 and 18 for sensing the load pressure of the control valve (not shown). Each unloading valve is spring biased as illustrated, and the pressure signal from the load adds to the spring bias of the unloading valve. The other end of each unloading valve is connected to supply line 28 by pilot lines 36 and 38, respectively, for sensing the outlet pressure of the primary pump 12.

The spring bias for the primary pump unloading spool valve 16 has a pressure equivalent which is greater than the spring bias pressure equivalent of the secondary pump unloading spool valve 18. This permits phasing of the unloading valves so that the primary pump 12 supplies all of the fluid demand for the circuit 10 until the demand exceeds that pump's capacity.

The primary pump unloading spool valve 16 may be set at a differential pressure of, for example, 200 psi which means that when the differential between the pressure in line 28 and the load pressure in line 34 equals or excees 200 psi, valve 16 will open, and the flow from pump 12 will be directed to reservoir 24 through conduit 40 and the return line 42 from the control valves. If the differential pressure for the primary pump unloading valve 16 is set at 200 psi, then the differential pressure setting for the secondary pump unloading spool valve 18 would be lower at, for example, 150 psi. When the differential between the pressure in line 28 and the load pressure in line 34 equals or exceeds 150 psi, valve 18 will open, and flow from pump 14 will be directed to reservoir 24 through conduit 44 and return line 42.

Thus, with these differential pressure settings for the unloading valves 16 and 18, primary pump 12 satisfies all of the fluid demand at lower flow requirements while secondary pump 14 vents all of its flow to reservoir 24 at an energy savings. When primary pump 12 can no longer supply the demand, the differential pressure between lines 28 and 34 reduces which permits secondary pump 14 to start adding flow through line 28.

Relief control is also provided for unloading valves 16 and 18 to permit venting of the flow from one or both pumps when a pre-set high pressure is reached. Relief valves 46 and 48 are connected to load-sense line 34 by pilot lines 50 and 52, respectively. Relief valve 46 is set at, for example, 2500 psi while relief valve 48 is set at, for example, 2000 psi. With these settings, if the pressure in load-sense line 34 equals or exceeds 2000 psi, valve 48 opens, and the flow in line 34 is vented to reservoir 24 through lines 54 and 42, thereby limiting pressure in line 52 to 2000 psi and permitting valve 18 to open for venting the discharge from pump 14 to reservoir 24 when the pressure in line 38 exceeds 2000 psi plus the spring bias pressure of valve 18. Similarly, if the pressure in load-sense line 34 equals or exceeds 2500 psi, valve 46 opens, and the flow in line 34 is vented to reservoir 24 through lines 56, 54 and 42, thereby permitting valve 16 to open for venting the discharge from pump 12 to reservoir 24 when the pressure in line 36 exceeds 2500 psi plus the spring bias pressure of valve 16.

The operation of the hydraulic circuit 10 will be further explained by using the following example wherein pump 12 has a displacement of 26 gpm, pump 14 has a displacement of 14 gpm, unloading valve 16 is set at a differential pressure of 200 psi, and unloading valve 18 is set at a differential pressure of 150 psi. If the control valves (not shown) are set in a neutral position, the discharge from both pumps 12 and 14 is vented through unloading valves 16 and 18 to reservoir 24. For flow demands in the hydraulic circuit 10 of 0–26 gpm at operating pressures, pump 12 supplies all of the flow requirements while the discharge of pump 14 is vented to reservoir 24. For flow demands of 26–40 gpm at operating pressures, secondary pump 14 adds to the flow from pump 12 to satisfy the larger flow demand. When load-sensing pressures are between 2000–2500 psi, pump 12 supplies the entire demand regardless of the flow demand from the control valves. This has a limiting horsepower effect since pump 14 is vented to reservoir 24 at low pressure due to the relief setting of valve 48.

It will be apparent to those skilled in the art that the closed center compensator unloading valves 16 and 18 can be incorporated into one valve body. Further, it will be apparent that the foregoing disclosure is exemplary in nature rather than limiting, the invention being limited only by the appended claims.

I claim:

1. A hydraulic circuit comprising:

a primary fixed displacement pump and a secondary fixed displacement pump with said pumps being connected to a reservoir for receiving hydraulic fluid, said primary pump having a discharge line connected to a first closed center compensator unloading valve and to a main supply line, said secondary pump having a discharge line connected to a second closed center compensator unloading valve and to said supply line, and a check valve being connected in said supply line at a location between said pump discharge lines;

a load-sense line connected to one end of each of said unloading valves for transmitting fluid pressure against one end of each of said unloading valves, a pilot line connected between the opposite end of each of said unloading valves and said supply line for transmitting fluid pressure against the opposite end of each of said unloading valves, said pilot lines being connected to said supply line downstream of said check valve, each of said unloading valves being spring biased at said one end toward a normally closed position, the fluid pressure in said load line adding to the spring bias force applied to each unloading valve, and each of said unloading valves being moved to an open position when the pressure in a pilot line exceeds the combined load line pressure and spring bias force, and the unloading valves being connected to said reservoir by a return line for venting the output of either pump to said reservoir when its unloading valve is in an open position; and the spring bias force for the primary pump unloading valve being substantially greater than the spring bias force for the secondary pump unloading valve for permitting phasing of the unloading valves such that the primary pump supplies all of the fluid demand for the circuit until the fluid demand exceeds the capacity of the primary pump at which time the secondary pump adds flow to supply larger fluid demands; and a first relief valve connected between said primary pump unloading valve and said return line and a second relief valve connected between said secondary pump unloading valve and said return line, and said first relief valve having a substantially greater relief setting than said second relief valve.

* * * * *